US006859961B1

(12) United States Patent
Barr

(10) Patent No.: US 6,859,961 B1
(45) Date of Patent: Mar. 1, 2005

(54) THERAPEUTIC BED COVER AND ASSOCIATED METHODS

(76) Inventor: John William Barr, 14350 Carlson Cir., Tampa, FL (US) 33626

( * ) Notice: Subject to any disclaimer, the term of this patent is extended or adjusted under 35 U.S.C. 154(b) by 0 days.

(21) Appl. No.: 10/629,328

(22) Filed: Jul. 29, 2003

Related U.S. Application Data

(60) Provisional application No. 60/399,266, filed on Jul. 29, 2002.

(51) Int. Cl.[7] ..... A47D 13/08
(52) U.S. Cl. ..... 5/424; 5/425
(58) Field of Search ..... 5/424–425, 632, 5/630, 647, 513, 655

(56) References Cited

U.S. PATENT DOCUMENTS

| | | | | |
|---|---|---|---|---|
| 2,644,173 | A | | 7/1953 | James |
| 4,042,278 | A | | 8/1977 | Jensen |
| 4,356,579 | A | | 11/1982 | Bond |
| 4,754,509 | A | | 7/1988 | Pollard |
| 4,873,734 | A | | 10/1989 | Pollard |
| 5,341,531 | A | | 8/1994 | Straub et al. |
| 5,357,641 | A | | 10/1994 | Schubert |
| 5,367,730 | A | * | 11/1994 | Sher ..... 5/655 |
| 5,381,571 | A | | 1/1995 | Gabhart |
| 5,530,974 | A | | 7/1996 | Rains et al. |
| 5,794,289 | A | | 8/1998 | Wortman et al. |
| 6,079,070 | A | | 6/2000 | Flick |
| 6,347,422 | B2 | | 2/2002 | Heavrin |
| 6,473,923 | B1 | | 11/2002 | Straub |
| 6,481,030 | B2 | | 11/2002 | Bravo et al. |
| 2002/0013383 | A1 | | 1/2002 | Perez et al. |
| 2002/0042954 | A1 | | 4/2002 | Straub |
| 2002/0170117 | A1 | | 11/2002 | Flick et al. |

* cited by examiner

*Primary Examiner*—Michael F. Trettel
*Assistant Examiner*—Fredrick Conley
(74) *Attorney, Agent, or Firm*—Allen, Dyer, Doppelt, Milbrath & Gilchrist, P.A.

(57) ABSTRACT

The invention discloses an apparatus and method including a bed and a therapeutic mattress having a cover therefor. The bed has a frame and a therapeutic mattress with a plurality of inflatable air chambers; a cover on the mattress has a generally planar extent sufficient for covering at least a portion of the mattress; a plurality of spaced apart bolsters extend upwardly from the top surface of the cover adjustably connected and oriented generally parallel to a periphery of the mattress; a plurality of connectors is positioned on the cover and are engageable with the mattress and/or the bed frame to thereon secure the cover; the plurality of bolsters includes at least two bolsters sufficiently spaced apart along a lateral periphery of the mattress to therebetween leave a gap to aid ingress and egress of a person, and at least one bolster positioned along the foot of the mattress.

25 Claims, 1 Drawing Sheet

THERAPEUTIC BED COVER AND ASSOCIATED METHODS

RELATED APPLICATION

This application claims priority from provisional application Ser. No. 60/399,266, which was filed on Jul. 29, 2002, and which is incorporated herein by reference in its entirety.

FIELD OF THE INVENTION

The present invention relates to the field of therapeutic beds used in patient care and, more specifically, to a therapeutic bed having a slip-over cover which incorporates raised bolsters along the side edges of the bed, leaving at least one entry-exit point for the patient along each side of the bed, and having a foot bolster which is adjustable in position along the foot of the bed.

BACKGROUND OF THE INVENTION

Therapeutic beds are in wide use in healthcare, including hospitals, rehabilitation centers, and long term care facilities. These beds are used not only for patients recovering from trauma or medical procedures, but also for invalid or elderly patients in long term care facilities. The term "therapeutic bed" is used herein to broadly identify a bed which is not merely a passive resting surface for the patient, but which through some structural component provides some patient treatment by a massaging action, movement, air cushion, or other effect.

It has long been known that patients confined to long term bed rest will tend to develop bed sores known in the art as "decubitus ulcers." These ulcers tend to be indolent, have a tendency to become sites of infection, and respond to treatment very slowly. For those reasons, one major purpose of a type of therapeutic bed is to provide some cushioning or variable movement to the patient, in an effort to reduce the development of decubitus ulcers.

It is also generally known that the types of patients for whom a therapeutic bed is best suited, will have some tendency to roll off the bed and onto the floor. Alternatively, many of these patients are thin and frail and exhibit a tendency to roll to the side of the mattress and become trapped between the side of the therapeutic mattress and the typical guard rail lining the sides of a therapeutic bed. Both of these circumstances are fraught with danger to the patient, and with potential liability for the health care facility.

SUMMARY OF THE INVENTION

With the foregoing in mind, the present invention provides a therapeutic bed including a mattress cover having raised bolsters along the side edges of the bed, so as to help reduce the chance that the patient will roll off the bed or become trapped between the side edge of the mattress and the side rail of the bed. The raised bolsters are positioned so as to leave therebetween at least one entry-exit point for the patient. Preferably such an entry-exit point is positioned along each side of the bed. The mattress cover of the present invention also has a foot bolster which is adjustable in position along the foot of the bed to accommodate patients of different height.

BRIEF DESCRIPTION OF THE DRAWING

Some of the features, advantages, and benefits of the present invention having been stated, others will become apparent as the description proceeds when taken in conjunction with the accompanying drawing, presented for solely for exemplary purposes and not with intent to limit the invention thereto, and in which.

DETAILED DESCRIPTION OF THE PREFERRED EMBODIMENT

Figure 1:
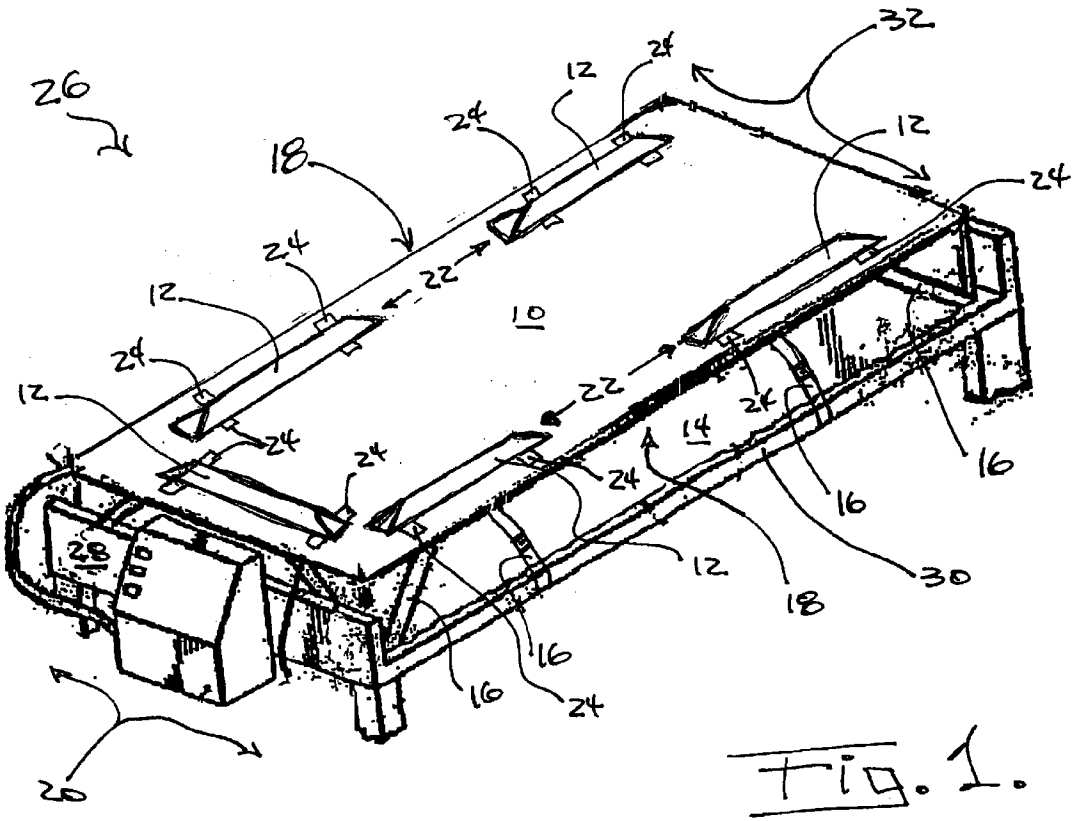
FIG. 1 is a perspective view of a preferred embodiment of the present invention.

The present invention will now be described more fully hereinafter with reference to the accompanying drawings, in which preferred embodiments of the invention are shown. Unless otherwise defined, technical and scientific terms used herein have the same meaning as commonly understood by one of ordinary skill in the art to which this invention pertains. Although methods and materials similar or equivalent to those described herein can be used in the practice or testing of the present invention, suitable methods and materials are described below. Any publications, patent applications, patents, and other references mentioned herein are incorporated by reference in their entirety. In case of conflict, the present specification, including any definitions, will control. In addition, the materials, methods and examples given are illustrative in nature only and not intended to be limiting. Accordingly, this invention may be embodied in many different forms and should not be construed as limited to the illustrated embodiments set forth herein. Rather, these illustrated embodiments are provided solely for exemplary purposes so that this disclosure will be thorough and complete, and will fully convey the scope of the invention to those skilled in the art. Other features and advantages of the invention will be apparent from the following detailed description, and from the claims.

FIG. 1 illustrates a cover 10 for a mattress 14 according to the present invention. The cover 10 comprises an expanse of material having a generally planar extent sufficient for covering at least a portion of an upper surface of the mattress 14, the expanse of material having a top and a bottom surface. A preferred embodiment of the cover 10 may be visualized having a structure similar to that of the typical fitted sheet which slips over an underlying mattress 14. A plurality of spaced apart elongated bolsters 12 extend upwardly from the top surface of the expanse of material and are preferably substantially triangular in cross section. Individual bolsters 12 of the plurality are adjustably positioned on the top surface of the expanse of material and are generally parallel to a periphery thereof, as well as generally parallel to a periphery of the mattress 14 over which the cover 10 is fitted. A plurality of connectors 16 is positioned on the expanse of material and is engageable with the mattress 14 to thereon secure the cover 10. The plurality of spaced apart bolsters 12 is positioned on the expanse of material so as to generally parallel at least lateral and foot peripheries of the mattress 14 and comprises at least two individual bolsters sufficiently spaced apart along a lateral periphery 18 of the mattress 14 to therebetween leave a gap 22 to aid ingress and egress of a person.

It is to be understood that the cover 10 disclosed herein is preferred for use with a therapeutic mattress 14. The term therapeutic mattress is intended to include specialty mattresses used for medical purposes, including mattresses for adjustable patient beds, mattresses having inflatable sections for aiding in reducing bed sores, and mattresses which support a person on a thin layer of air blown through small openings in the mattress. Accordingly, it is preferable that the plurality of bolsters 12 comprises individual bolsters having an elongated dimension, and most preferably that the bolsters comprise a generally triangular cross section, as it has been found that such a bolster shape is most advantageous for helping prevent a person from involuntarily rolling off the bed.

The invention includes the adjustably positioned bolsters 12 connected to the top surface of the expanse of material by at least one hook and loop strip fastener 24, so as to be easily positionally adjustable relative to the person and to the periphery of the mattress 14. In that manner, the distance between the bolster 12 and a periphery of the mattress may be changed according to need or preference. In particular, at least one adjustably positioned bolster 12 is repositionable on the top surface of the expanse of material so as to change the distance between the bolster and a foot periphery 20 of the mattress 14. The bed 26 may thus be adjusted to account for the body length of a person thereon, and to provide the person with a convenient and relatively soft foot cushion which helps prevent injury due to contact with the hard footboard 28 used in most medical beds. This bolster 12 adjustably placed toward the foot of the bed 26 helps prevent the person from slipping toward the footboard 28.

Those skilled in the art will readily recognize that the invention includes, in combination, a bed 26 and a therapeutic mattress 14 having a cover 10 therefor. The combination comprises a bed 26 having a frame 30 for thereon supporting a mattress 14. A therapeutic mattress 14 is positioned on the frame 30, the mattress having a plurality of inflatable air chambers, and a periphery including a head periphery 32, a foot periphery 20, and two lateral peripheries extending therebetween. A cover 10 is positioned on the mattress 14, the cover having a generally planar extent sufficient for covering at least a portion of an upper surface of the mattress, the cover having a top and a bottom surface. A plurality of spaced apart bolsters 12 extends upwardly from the top surface of the cover 10, wherein individual bolsters of the plurality are adjustably connected to the top surface of the cover and oriented generally parallel to a periphery of the mattress 14. A plurality of connectors 16 is positioned on the cover 10 and engageable with at least one other component of the combination to thereon secure the cover. In this embodiment, the plurality of spaced apart bolsters 12 includes at least two individual bolsters sufficiently spaced apart along a lateral periphery 18 of the mattress 14 to therebetween leave a gap 22 to aid ingress and egress of a person, and at least one individual bolster 12 positioned along the foot periphery 20 of the mattress as described above.

In the combination it is preferable that the plurality of bolsters 12 comprises individual bolsters having an elongated dimension, and most preferable if the bolsters have a triangular cross section. Moreover, the adjustably positioned bolsters 12 are best connected to the top surface of the cover 10 by at least one hook and loop strip fastener 24, so that an adjustably positioned bolster is repositionable on the top surface of the cover for changing the distance between the bolster 12 and a periphery of the mattress 14. As also noted above, in the combination at least-one adjustably positioned bolster is repositionable on the top surface of the expanse of material so as to change the distance between the bolster 12 and a foot periphery 20 of the mattress 14.

The plurality of connectors 16 in the combination could comprise straps for securing the cover 10 to the mattress 14 and/or to the bed frame 30. As with the typical fitted sheet, the cover 10 of the combination optionally includes peripheral extensions fitted over peripheries of the mattress 14 and may further comprise at least one strap for securing the cover to the bed frame 30.

A method aspect of the invention includes helping prevent a person from accidentally rolling off a therapeutic bed 26. The method comprises from the start providing a bed 26 having a frame 30 and a therapeutic mattress 14 thereon, the mattress having a plurality of inflatable air chambers, and a periphery including a head periphery 32, a foot periphery 20, and two lateral peripheries extending therebetween. Then securing a cover 10 on the therapeutic mattress 14, the cover having a generally planar extent sufficient for covering at least a portion of an upper surface of the mattress, the cover having a top and a bottom surface. Next, adjustably positioning a plurality of bolsters 12 spaced apart on the top surface of the cover 10 and extending upwardly therefrom, wherein individual bolsters of the plurality are connected thereto and oriented generally parallel to a periphery of the mattress 14. Then securing the cover 10 to the bed 26 by connecting a plurality of connectors 16 therebetween. In the method, adjustably positioning includes connecting at least two individual bolsters 12 on the top surface of the cover 10 sufficiently spaced apart along a lateral periphery 18 of the mattress 14 to therebetween leave a gap 22 to aid ingress and egress of a person, and connecting at least one individual bolster 12 along the foot periphery 20 of the mattress adjustably responsive to body length of a person using the bed.

Preferable, but optional aspects of the method include wherein the plurality of bolsters 12 comprises individual bolsters having an elongated dimension, and particularly wherein individual bolsters have a generally triangular cross section. Further, adjustably positioned bolsters 12 are connected to the top surface of the cover 10 by at least one hook and loop strip fastener 24 and are repositionable on the top surface of the cover so as to change the distance between the bolster 12 and a periphery of the mattress 14. As noted previously, it is preferable that at least one adjustably positioned bolster 12 is repositionable on the top surface of the expanse of material so as to change the distance between the bolster and a foot periphery 20 of the mattress 14. In the method, securing may comprise connecting the cover 10 to the mattress 14, and may comprise connecting the cover to the bed frame 30. Moreover, in the method securing may also comprise fitting peripheral extensions of the cover 10 over the mattress 14 in the manner of a fitted sheet.

In the drawings and specification, there have been disclosed a typical preferred embodiment of the invention, and although specific terms are employed, the terms are used in a descriptive sense only and not for purposes of limitation. The invention has been described in considerable detail with specific reference to these illustrated embodiments. It will be apparent, however, that various modifications and changes can be made within the spirit and scope of the invention as described in the foregoing specification and as defined in the appended claims.

What is claimed is:

1. A cover for a mattress, comprising:

an expanse of material having a generally planar extent sufficient for covering at least a portion of an upper surface of said mattress, said expanse of material having a top and a bottom surface;

a plurality of spaced apart elongated bolsters extending upwardly from the top surface of said expanse of material and being substantially triangular in cross section, wherein individual bolsters of said plurality are adjustably positioned on the top surface of said expanse of material and are generally parallel to a periphery thereof; and a plurality of connectors positioned on said expanse of material and engageable with said mattress to thereon secure said cover;

wherein said plurality of spaced apart bolsters are positioned on said expanse of material so as to approximately parallel at least lateral and foot peripheries of said mattress and comprises at least two individual bolsters sufficiently spaced apart along a lateral periphery of the mattress to therebetween leave a gap to aid ingress and egress of a person.

2. The cover of claim 1 wherein the ma further comprises a therapeutic mattress.

3. The cover of claim 1, wherein said plurality of bolsters comprises individual bolsters having an elongated dimension.

4. The cover of claim 1, wherein said plurality of bolsters comprises individual bolsters having a generally triangular cross section.

5. The cover of claim 1, wherein the adjustably positioned bolsters are connected to the top surface of said expanse of material by at least one hook and loop strip fastener.

6. The cover of claim 1, wherein an adjustably positioned bolster is repositionable on the top surface of the expanse of material so as to change the distance between the bolster and a periphery of the mattress.

7. The cover of claim 1, wherein at least one adjustably positioned bolster is repositionable on the top surface of the expanse of material so as to change the distance between the bolster and a foot periphery of the mattress.

8. In combination, a bed and a therapeutic mattress having a cover therefor, the combination comprising:

a bed having a frame for thereon supporting a mattress;

a therapeutic mattress positioned on said frame, said mattress having a plurality of inflatable air chambers, and a periphery including a head periphery, a foot periphery, and two lateral peripheries extending therebetween;

a cover positioned on said mattress, said cover having a generally planar extent sufficient for covering at least a portion of an upper surface of said mattress, said cover having a top and a bottom surface;

a plurality of spaced apart bolsters extending upwardly from the top surface of said cover, wherein individual bolsters of said plurality are adjustably connected to the top surface of said cover and oriented generally parallel to a periphery of said mattress; and a plurality of connectors positioned on said cover and engageable with at least one other component of said combination to thereon secure the cover, wherein said plurality of spaced apart bolsters includes at least two individual bolsters sufficiently spaced apart along a lateral periphery of the mattress to therebetween leave a gap to aid ingress and egress of a person, and at least one individual bolster positioned along the foot periphery of the mattress.

9. The combination of claim 8, wherein said plurality of bolsters comprises individual bolsters having an elongated dimension.

10. The combination of claim 8, wherein said plurality of bolsters comprises individual bolsters having a generally triangular cross section.

11. The combination of claim 8 wherein the adjustably positioned bolsters are connected to the top surface of said cover by at least one hook and loop strip fastener.

12. The combination of claim 8, wherein an adjustably positioned bolster is repositionable on the top surface of said cover so as to change the distance between the bolster and a periphery of the mattress.

13. The combination of claim 8, wherein at least one adjustably positioned bolster is repositionable on the top surface of the expanse of material so as to change the distance between the bolster and a foot periphery of the mattress.

14. The combination of claim 8 wherein said plurality of connectors comprises straps for securing the cover to the mattress.

15. The combination of claim 8, wherein said plurality of connectors comprises straps for securing the cover to the bed frame.

16. The combination of claim 8, wherein said cover includes peripheral extensions fined over peripheries of the mattress and further comprises at least one strap for securing the cover to the bed frame.

17. A method of helping prevent a person from accidentally roiling off a therapeutic bed, the method comprising:

providing a bed having a frame and a therapeutic mat thereon, the mattress having a plurality of inflatable air chambers, and a periphery including a head periphery, a foot periphery, and two lateral peripheries extending therebetween;

securing a cover on the therapeutic mattress, the cover having a generally planar extent sufficient for covering at least a portion of an upper surface of the mattress, the cover having a top and a bottom surface;

adjustably positioning a plurality of bolsters spaced apart on the top surface of the cover and extending upwardly therefrom, wherein individual bolsters of the plurality are connected thereto and oriented generally parallel to a periphery of said mattress; and securing the cover to the bed by connecting a plurality of connectors therebetween;

wherein adjustably positioning includes connecting at least two individual bolsters on the top surface of the cover sufficiently spaced apart along a lateral periphery of the mattress to therebetween leave a gap to aid ingress and egress of a person, and connecting at least one individual bolster along the foot periphery of the mattress adjustably responsive to body length of a person using the bed.

18. The method of claim 17, wherein the plurality of bolsters comprises individual bolsters having an elongated dimension.

19. The method of claim 17, wherein the plurality of bolsters comprises individual bolsters having a generally triangular cross section.

20. The method of claim 17, wherein the adjustably positioned bolsters are connected to the top surface of the cover by at least one hook and loop strip fastener.

21. The method of claim 17 wherein an adjustably positioned bolster is repositionable on the top surface of the cover so as to change the distance between the bolster and a periphery of the mattress.

22. The method of claim 17, wherein at least one adjustably positioned bolster is repositionable on the top surface of the expanse of material so as to change the distance between the bolster and a foot periphery of the mattes.

23. The method of claim 17, wherein securing comprises connecting the cover to the mattress.

24. The method of claim 17, wherein securing comprises connecting the cover to the bed frame.

25. The method of claim 17, wherein securing further comprises fitting peripheral extensions of the cover over the mattress.

* * * * *